United States Patent [19]

Wilkins et al.

[11] Patent Number: 5,067,545

[45] Date of Patent: Nov. 26, 1991

[54] MINI BLIND HOLD DOWN BRACKET

[76] Inventors: Bruce G. Wilkins, 11702 Braewick; Randolf E. Helm, 3308 Fountain View, #19, both of Houston, Tex. 77035

[21] Appl. No.: 480,651

[22] Filed: Feb. 15, 1990

[51] Int. Cl.[5] ..... E06B 9/30

[52] U.S. Cl. ..... 160/178.1; 160/902

[58] Field of Search ..... 160/178.1, 902, 251; 248/254, 262, 267; 16/255, 256, 257, 277, 281, 286

[56] References Cited

U.S. PATENT DOCUMENTS

| | | | |
|---|---|---|---|
| 699,698 | 5/1902 | Murray | 16/256 |
| 1,196,428 | 8/1916 | Briel | 16/256 |
| 1,347,126 | 7/1920 | Sell | 248/254 |
| 1,418,919 | 6/1922 | Hall | 16/286 |
| 2,901,035 | 8/1959 | Anderle | 160/178.1 |
| 2,925,861 | 2/1960 | Long | 160/178.1 |
| 3,447,586 | 6/1969 | Anderle | 160/178.1 |
| 4,088,173 | 5/1978 | Antich | 160/178.1 X |

*Primary Examiner*—David M. Purol

*Attorney, Agent, or Firm*—John P. Halvonik

[57] ABSTRACT

A hold down bracket for holding down the bottom rail on mini blinds. The bracket is a spring loaded, hinged, flat folding, lower bracket for miniblind installation to doors. The bracket is designed to prevent accidental injury when the blind is in the stacked up position and to maintain pressure on the bottom rail of the mini blind so as to prevent it from working itself loose when in the fully extended position.

3 Claims, 1 Drawing Sheet

6
7
3
2
9
5

8
4
9
1
2
3
6

MINI BLIND HOLD DOWN BRACKET

BACKGROUND OF THE INVENTION

1. Field of the Invention

The invention relates to the field of blinds and the brackets that secure them. In particular the present invention provides a new bracket for miniblinds that is a spring loaded hinge that folds flat when not in use.

2. Description of the Prior Art

While there are miniblind brackets, there are none that applicant is aware of that are spring loaded or that provide as many advantages that the present invention does.

SUMMARY OF THE INVENTION

The invention provides a miniblind hold down bracket that is in the form of a hinge that has wires running along it so as to keep the bracket flat when not in use and to keep pressure on the bottom rail of the miniblind when the bracket is in use.

It is the object of this invention to provide a miniblind hold down bracket that will lie flat when not in use.

Another purpose is to provide a hold down bracket that will keep pressure on the bottom rail of the mini-blind when the bracket is in use.

Still another object of the invention is to provide a mini blind bracket that is less likely to cause injury to humans and animals.

DESCRIPTION OF THE PREFERRED EMBODIMENT

Figures 1, 2, 3, 4:
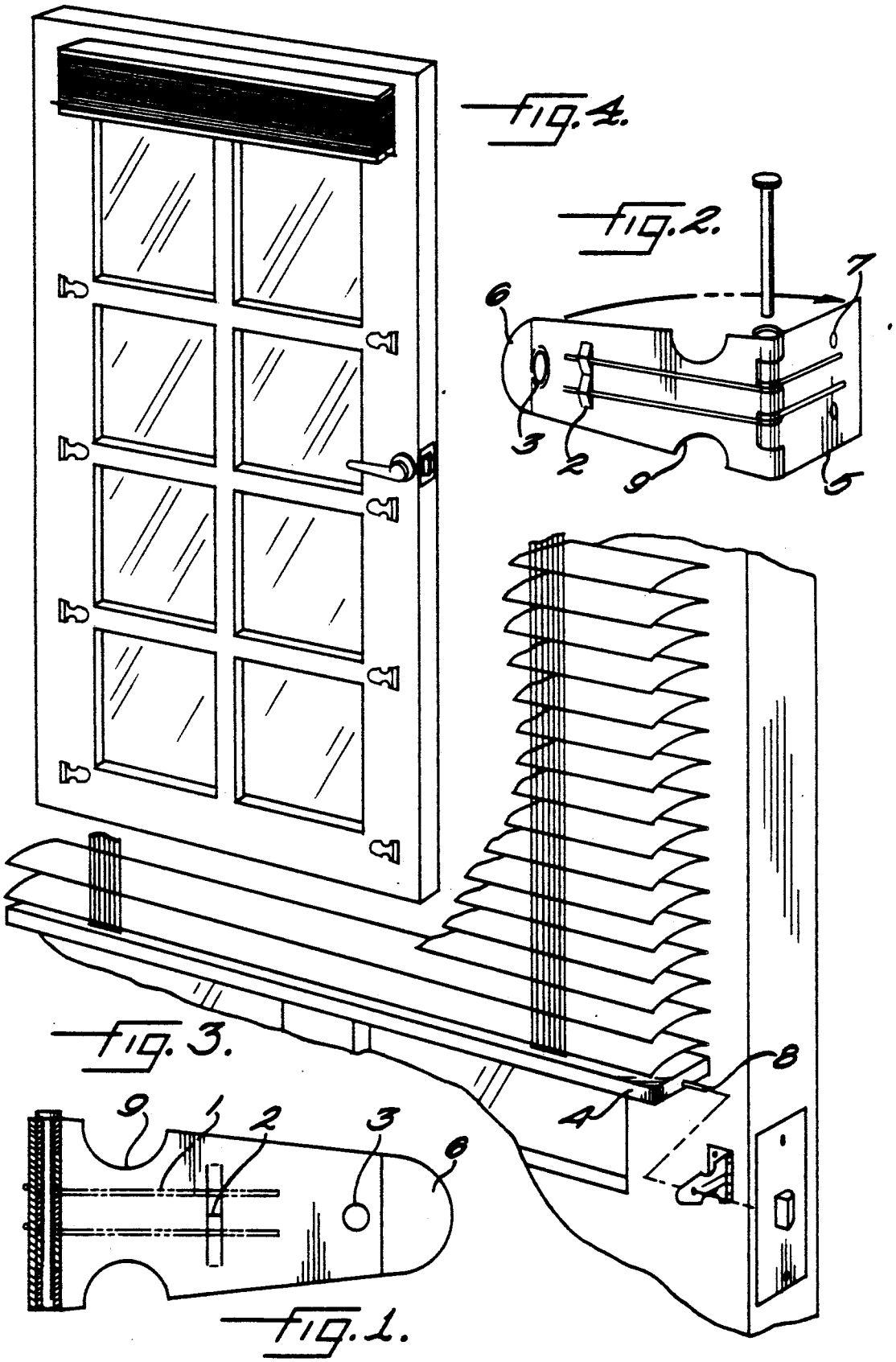
FIG. 1 shows a side view of the exploded bracket
FIG. 2 shows the bracket
FIG. 3 shows the bracket in use
FIG. 4 shows a plurality of brackets in use

The hinge of the present invention is built along the lines of an everyday hinge, see FIG. 1. Two wire springs 1 are placed along the back edge of the hinge which serves to keep the bracket folded flat when the bottom rail 4 of the miniblind is not being secured by the bracket, i.e. when the bracket is not in use. The wire springs may be typically secured to the bracket by raised up portions 2 at the end of the hinge, see FIG. 2. One end of the hinge 6 has an opening 3 in it to permit the insertion of the pin 8 on the endcap of the bottom rail of the miniblind 4. Typically, two such brackets are used, one for each end of the rail and they are set a certain distance apart based on the width of the mini-blind, see FIG. 4. Of course one must choose a distance that will permit the insertion of the two end pins 8 of the rail of the miniblind into the two brackets. Preferably, one end of the bracket 5 (the one that is not securing the rail) is mounted on the door or other structure that the miniblind is on. Preferably the end will have two holes 7 that permit the insertion of nails or screws in the hinge and into the door. Other means of securing the bracket to the door are possible.

All present day hold-down brackets for mini-blinds are made out of either metal or plastic. All designs are L-shaped with a short base and a longer side which the pin from the end cap, on the bottom rail of the mini-blind slips into or hooks under.

The problem with the plastic hold-downs is that they break very easily. They don't bend and they can snap off if there is too much pressure exerted on them. This can leave a sharp edge which is, unsafe for crawling children or adults who may bump into it. Plastic presents another problem in that animals or children may chew on the bracket. A bracket that folds flat would eliminate this problem. The plastic hold downs come loose quite easily allowing the bottom rail of the mini-blind to be unsecured and swing loose. Therefore it tends to scratch up the surface of the door to which it is mounted when the door is opened and closed.

The metal hold-downs on the market now are better than the plastic ones, but they have their faults also. They are L-shaped and will bend if you bend them, but they will stay in whatever position you bend them in. This is bad, because if someone hits the bottom rail, on the mini-blind, and bends the bracket out, the rails may slide out of the bracket and the blind flops around when the door is open. The metal brackets are sharp regardless of whether they break off or not. This is dangerous to crawling children, adults and animals because one may be cut by the sharp metal. On commercial doors, people are bumping into the brackets all the time and getting hurt or breaking them off. After a bracket has been damaged, whenever the door is opened, the blind starts to swing and scratch up the finish on the door because it is not secured.

The collapsible hold-down bracket of the present invention is both functional and safe. It automatically folds flat when the mini-blind bottom rail is removed. Therefore there is nothing sticking out from the door for people to catch their legs and ankles on. It also reduces the chances for animals to chew on the bracket as it will be unnoticed. Again, people will probably not be impaled against it and children will be unlikely to bump into it while crawling. If someone should bump the blind out of the brackets, the brackets automatically close and the hazard, is eliminated.

The other advantage of the collapsible hold-down bracket is that because of the tension spring pulling inward, the bracket always maintains tension on the bottom rail, holding it in place. When the doors swing open and shut, it throws the weight of the blind from side to side. This can eventually loosen conventional brackets and the bottom rail will jump loose. But with the bracket of the present invention, tension is always there so as the weight of the blind shifts, so does the tension. Therefore, the blind doesn't work itself loose.

A lot of times, people like to raise the blinds up on a door during the day and let them down at night. When they do this, they run into problems with the conventional hold-downs. In order to have the blind in the stacked up position on the door and secured and in the extended position and secured one needs two sets of hold down brackets. One set at the bottom of the door and one set at the top. The conventional hold down brackets stick out from the door 1 and ¼' all of the time. This presents a hazard when the blind is in the fully extended position and the top brackets are not in use. People don't notice the brackets sticking out from the door and they may bump into them if they push open the door with their shoulders or even their hands. There again, with the collapsible hold-down bracket you can place them at eye level, and when the blind is let down at night, the brackets fold closed and are out of the way. You could even place 3 or 4 pair on a door, depending on where you want to stop the blind.

The collapsible hold-down bracket is designed with notches 9 on the side so it will be easier to install when it is in the closed position. The hinged design is used for ease of operation and simplicity. Two springs are preferred for added strength and stability. The hole for the bottom rail pin is standardized for the industry.

Our bracket is sleek in design and functional in operation. It's safe and secure. It's a hold-down bracket the industry and the consumer can rely on.

We claim:

1. The combination of a miniblind and a bracket to secure said miniblind to a support structure comprising:

said miniblind having a bottom rail projecting laterally from each side of said miniblind and being disposed near the bottom thereof, said bracket having a base bracket halve and a securing bracket halve, said halves being connected by a hinge, said base halve having holes for mounting said base halve onto said support structure, said securing halve having a circular shaped, outwardly raised flange capable of securing thereto said bottom rail, said halves held in resilient relation to each other so that said securing halve folds flat against said base halve when not securing said bottom rail, said securing halve having an outside surface and an inside surface, said inside surface being that surface which contacts said base bracket when said securing halve is not securing said bottom rail, said circular shaped flange being located on said inside surface, and a resilient means secured to said inside surface of said securing halve and secured to said base halve for holding said halves in said resilient relation to each other.

2. The combination of claim 1 where said securing halve has cut out portions along the top and bottom sides thereof, said cut out portions being aligned with said mounting holes when said halves are folded against each other so that said securing halve will not interfere with said mounting of said base halve.

3. The combination of claim 2 wherein said inside surface has a raised portion for securing said resilient means thereto.

* * * * *